United States Patent [19]

Hotani

[11] Patent Number: 4,462,131

[45] Date of Patent: Jul. 31, 1984

[54] PROCESS AND APPARATUS FOR THE MERCERIZATION OF SLIVERS

[75] Inventor: Mitsuhiro Hotani, Ibaraki, Japan

[73] Assignee: Toyo Boseki Kabushiki Kaisha, Osaka, Japan

[21] Appl. No.: 412,521

[22] Filed: Aug. 26, 1982

[51] Int. Cl.[3] ..... D06B 7/02

[52] U.S. Cl. ..... 8/151.2; 68/22 R; 68/45; 68/62; 68/158; 68/205 R

[58] Field of Search ..... 8/151, 151.2, 125; 68/22 R, 44, 45, 62, 158, 205 R

[56] References Cited

U.S. PATENT DOCUMENTS

| | | | |
|---|---|---|---|
| 670,098 | 3/1901 | Brassard | 68/45 X |
| 2,058,835 | 10/1936 | Schulte | 8/151.2 X |
| 2,239,636 | 4/1941 | Weiss | 68/22 R X |

FOREIGN PATENT DOCUMENTS

| | | | |
|---|---|---|---|
| 14675 | 5/1978 | Japan | 68/62 |
| 254706 | 2/1927 | United Kingdom | 68/205 R |

*Primary Examiner*—Philip R. Coe

*Attorney, Agent, or Firm*—Wenderoth, Lind & Ponack

[57] ABSTRACT

The invention relates to a method and apparatus for mercerizing a cellulosic fiber-containing sliver with an aqueous solution of caustic soda of high concentration. The sliver is transported between a belt conveyor and a press belt to hold it in place and transported in a downwardly inclined direction, then transferred from the belt conveyor onto a net conveyor having mesh openings and transported by said net conveyor such that the excessive caustic soda solution drips through the mesh openings of the net conveyor and the caustic soda is finally squeezed out of the sliver by means of squeezed rollers. The squeezed sliver material is then washed with water by transporting it to another net conveyor containing press rollers thereupon by passing the sliver between the net conveyor and press rollers located in a water-washing tub. An apparatus to effect this process also constitutes part of the present invention. The disclosed method makes it possible to mercerize a sliver containing cellulosic fibers so that it is not broken and to accomplish this mercerization in an efficient and economical manner, whereby mercerized yarns and knit fabrics can be produced which are excellent in bulkiness and softness.

5 Claims, 1 Drawing Figure

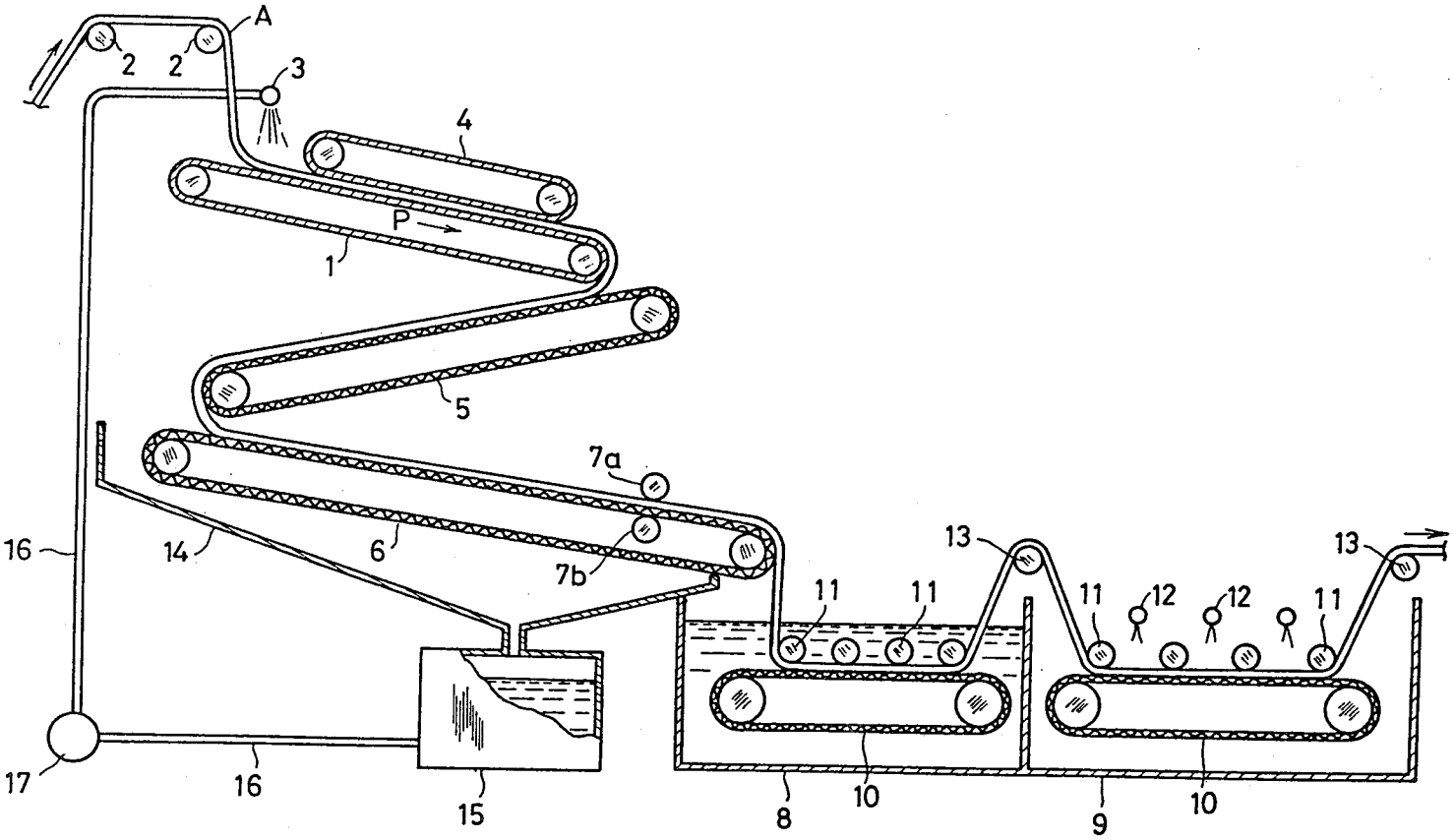
A
2
2
3
4
P
1
5
7a
7b
6
14
16
16
17
15
8
10
11
11
12
12
11
13
13
9
10

PROCESS AND APPARATUS FOR THE MERCERIZATION OF SLIVERS

The present invention relates to a method and apparatus for the mercerization of slivers.

Mercerized knit products made of cotton yarns or blended yarns of cotton and synthetic fibers are characterized in that they have excellent luster and dyeability and are clear in color, in addition to their good dimensional stability. However, the mercerization has been heretofore conducted in the form of yarns or knit fabrics, so that by the strong shrinking action of cotton fibers resulting from the mercerization treatment, the hand feel of the yarns and the knit fabrics is made harsh. Because of this, they have a defect in that they are lacking in bulkiness and softness as knit materials for winter use. Also, since it is difficult to conduct uniform mercerization and the dyeing speed is considerably increased by the mercerizing treatment, and dyeing unevenness is liable to occur. Therefore there has been a necessity for prolonging the dyeing time and also there has been an increase in defective products, thereby making the process uneconomical.

A method is known wherein raw cotton after removal of coarse impurities such as cottonseed dust, etc. is alkali-scoured, bleached, dried, oil-treated, fed to a blowing machine and spun (Japanese Patent Publication No. 6724/1980). In this known method, when mercerization is conducted using an aqueous caustic soda solution of high concentration in place of that of low concentration, the raw cotton forms hard lumps which make the opening of cotton fibers difficult. This renders the spinning process almost impossible. Even if spinning could be conducted, since a large quantity of short fibers are removed as waste cotton during the blowing step and the combing step after the above mentioned treatment, the caustic soda used for that waste cotton becomes useless and is uneconomic. Also is known a method wherein a flax sliver is continuously immersed in an aqueous caustic soda solution to shrink the sliver (British Pat. No. 1,057,245). When a cotton sliver in place of the flax sliver is immersed into an aqueous caustic soda solution by introducing it by means of guide rollers, etc., since the length of the cotton fibers is shorter than that of the flax fibers, the cotton sliver will be broken in the solution and therefore it is impossible to treat it in sliver form.

The present invention provides a method and apparatus which makes it possible to mercerize a sliver containing cotton fibers and/or other cellulosic fibers so that it is not broken, whereby there can be obtained mercerized yarns and knit fabrics which are excellent in bulkiness and softness.

Therefore, the present invention provides a method of mercerizating a sliver characterized by impregnating a cellulosic fiber-containing sliver with an aqueous solution of caustic soda of high concentration while transporting the same as held between a belt conveyer and a press belt which contacts the upper surface of said belt conveyer, transporting said sliver after transferring it to a net conveyer for timing, while completing the reaction and dripping a part of the caustic soda solution through the meshes of the net conveyer, squeezing the solution out of the sliver by means of squeeze rollers, introducing the sliver into water, and washing the sliver with water while transporting the same as held between a net conveyer for water-washing and press rollers.

The present invention also provides an apparatus for mercerizing a sliver wherein a belt conveyer having on its upper surface a press belt which presses it, a net conveyer for timing and water-washing tubs are arranged in succession, a feed opening for allowing an aqueous solution of caustic soda to flow onto the upper surface of said belt conveyer is provided above the end portion of the supply side of the belt conveyer, a net conveyer for water-washing and on its upper surface a plurality of press rollers are provided in the water-washing tubs in such a manner that the cellulosic fiber-containing sliver is led to said belt conveyer, a net conveyer for timing and water-washing net conveyer successively and said sliver is placed on these conveyers linearly in the transporting direction.

The invention will be further explained by referring partly to the accompanying drawing, which is a schematic side view of an apparatus embodying the present invention.

A belt conveyer 1 arranged in an upper position is composed of an impermeable sheet made of rubber, synthetic resin or the like, and is provided in an inclined manner so that the front of its advancing direction (the direction of the arrow mark P) is lowered. Above the end portion of its supply side, there are provided letting-off rollers 2,2 and a feed opening 3 for causing an aqueous solution of caustic soda to flow down onto the upper surface of the belt conveyer 1. On the upper surface of the central part of the belt conveyer 1, an endless press belt 4 composed of a similar impermeable sheet as mentioned above is caused to travel while being pressed down. Below this belt conveyer 1, a first net conveyer 5 and a second net conveyer 6 for timing made of synthetic fibers such as polyvinyl chloride fibers, glass fibers or stainless steel are provided in zigzag form, each inclined downward. On the letting-off side of the second net conveyer 6, a pair of upper and lower squeeze rollers *7a, 7b* are provided. Below the end part of the letting-off side of this second net conveyer, there are provided in sequential order a first water-washing tub 8 and a second water-washing tub 9. Inside the first water-washing tub 8 and the second water-washing tub 9, there are provided a net conveyer 10 for water-washing composed of fibers or wires similar to those of said net conveyers 5 and 6 and a plurality of press rollers 11 pressed on its upper surface, respectively. Furthermore, there are provided above the second water-washing tub, a plurality of water-jetting nozzles 12 and at the upper part before and after the second water-washing tub, letting-off rollers 13, respectively. Below the second net conveyer 6 for timing, a trough 14 for collecting the solution and a tub 15 of the caustic soda solution connected thereto are arranged. The solution feed opening 3 is connected to this solution tub 15 through a solution feed pipe 16 and a pump 17.

When a sliver A is fed on the belt conveyer 1 by the rollers 2,2 and a high concentration aqueous caustic soda solution (14–24%) is fed to the sliver A from the solution feed opening 3, the sliver A is transported while being held between the belt conveyer 1 and the press belt 4. During this time, the sliver A is impregnated with the caustic soda solution and swells. The sliver A is then transferred to the net conveyers 5,6 and is caused to travel. During this time, the reaction is completed and an excess quantity of the caustic soda solution is caused to drip through the meshes of the net conveyers 5,6, and further squeezed out of the sliver A by the squeeze rollers *7a, 7b*. Thereafter, the sliver A is introduced into the first and second water-washing tubs 8, 9 where it is washed with water. The sliver A is then transported to an acid treating step (not shown) and an oiling step.

The sliver A includes a carded sliver spun from raw cotton through a blowing machine and a carding engine, a combed sliver further spun through a comber, etc. which is a non-twisted fiber assembly in band form or in rope form. The silver A used in this invention may be either a sliver composed solely of cellulosic fibers such as cotton, flax, polynosic rayon, etc. or a sliver composed of a mixture of cellulosic fibers with synthetic fibers such as polyester fibers, polyamide fibers, etc.

By setting the travelling speed of the belt conveyer 1 and the peripheral speed of the letting-off rollers 2, 2 at an equal rate, the sliver A can be placed linearly without meandering or being placed one over another, and a plurality of such slivers can be placed in parallel. The sliver A is immersed in the high concentration aqueous caustic soda solution in such a state that it is pressed from above on the conveyer belt 1 by the press belt 4. Accordingly, the fiber arrangement in the sliver A is not disordered by the swelling caused by the impregnation. Since the belt conveyer 1 is composed of an impermeable sheet and is inclined below forward in the travelling direction, the caustic soda solution flows along the sliver A and is absorbed to said sliver without loss. In order to prevent the fiber arrangement of the sliver A from being disordered by the caustic soda solution which is caused to flow down through the solution feed opening 3, the feed opening 3 is preferably set near the press belt 4 with the end of the opening being set upward at a low height, to overflow the caustic soda solution gently from this low position.

The net conveyers 5, 6 below the belt conveyer 1 are driven at a speed substantially the same speed as the belt conveyer 1, and the sliver A swollen by the impregnation with the caustic soda solution is placed linearly on the net conveyers 5, 6. The net conveyers 5, 6 have a large number of meshes over the whole surface, and when the sliver A is placed on the conveyers 5, 6, an excess quantity of the caustic soda solution contained in the sliver A drips or flows down below through the meshes. Accordingly, the fibers does not substantially float or move in the sliver A, so that the fiber arrangement is not disordered while the sliver A is transported by the net conveyers 5, 6 and squeezed between the squeeze rollers *7a*, *7b*. The caustic soda solution which has flowed down below is collected in the solution tub 15 through the solution collecting trough 14 and thereafter it is sent again to the solution feed opening through the solution feed pipe 16 and the pump 17.

The sliver A let-off from the second net conveyer 6 is then introduced into the first water-washing tub 8. Since the sliver is placed linearly on the water-washing net conveyer 10 and is transported while being pressed from above by the press rollers 11, the sliver A is prevented from floating up and is washed with water without being broken, with most of the caustic soda solution in the sliver A being removed. In this case, since the sliver A let-off from the second conveyer 6 is very weak in strength, the water in the first water-washing tub 8 desirably does not substantially flow. The sliver A is then transported while being held between the net conveyer 10 and the press rollers 11 in the second water-washing tub 9, and during this time the sliver A is washed with water jetted from the nozzles 12. At this time, since the sliver A has been remarkably shrunk by the water-washing in the first water-washing tub 8 and has become stronger, it is not broken by the shower washing.

By subjecting the sliver A to acid treatment, water-washing and oiling treatment subsequently to the shower washing, the mercerization is finished. Since the strength of the sliver A has been elevated, the above treatments including acid treatment can be carried out either by a conveyer system or roller system. The sliver A after being oiled is dried and is sent to the spinning process where it is spun. At this time, since the fiber arrangement is maintained in parallel without being disordered, the sliver A can be easily spun into yarns. Also, since the sliver A shrunk by mercerization is oiled and dried and then fed to a drawing frame, fly frame and ring frame successively and opened, the yarn thus obtained have the same degree of bulkiness and softness as the usual non-mercerized spun yarns, and in addition it has luster which is not seen in the usual spun yarns. Since the mercerized sliver A has been elevated in strength as mentioned above, the sliver can be package-dyed by an Obermayer dyeing machine or continuously dyed by padders and when oiled and dried and thereafter can be spun in the same way as mentioned above. In this case, even if dyeing unevenness may occur due to an increase in dyeing speed, the dyeing unevenness will be eliminated by the doubling of slivers in the drawing step. Also, it is possible to produce grandrelle yarns by blending different color slivers in the drawing step.

In the above-mentioned mode of practice of the present invention, it is possible to omit the second net conveyer 6 by elongating the length of the first net conveyer 5. In this case, it is possible to provide the first net conveyer 5 at a position from below to the right of the end of the belt conveyer 1, and it is also possible to provide it horizontally without being inclined. Also, it is possible to omit the nozzles 12 by filling the second water-washing tub 9 with water in the same way as in the first water-washing tub 8. Naturally, the number of the sliver A placed on the belt conveyer 1 may be either one or a plural number.

In the following the invention will be explained more concretely by way of Example.

EXAMPLE

A sliver A composed solely of cotton fibers and obtained from a comber was mercerized by the apparatus of the drawing explained above. The sliver A was placed linearly on the belt conveyer 1 which is travelling at a speed of 6 m/min. An aqueous caustic soda solution of 18° C. having a concentration of 18.7% was dropped on the sliver, which was treated on the belt conveyer 1, the first net conveyer 5 and the second net conveyer 6, each for 10 seconds. The sliver was then washed with water in the first water-washing tub 8 and the second water-washing tub 9, each for 15 seconds. Thereafter, the sliver was neutralized for 10 seconds with an aqueous solution of acetic acid having a concentration of 5 g/l, washed with running water for 30 seconds and dehydrated with squeeze rollers, to finish the mercerizing treatment. After oiling and drying, the sliver was spun into a 40-count (English type cotton count) cotton yarn. With this cotton yarn, a circular rib fabric for underwear was knitted by a 19-gauge circular rib fabric machine. On the other hand, a 40-count (English type cotton count) cotton yarn was spun by the usual spinning process and was knitted into a similar circular rib fabric as mentioned above. Thereafter, the fabric was mercerized to obtain a circular rib fabric for underwear (Comparison Example). Luster and hand feel were evaluated for the circular rib fabrics of Example and Comparison Example. It was found that the hand feel of Example fabric was soft and warm while that of Comparison Example was harsh and cool. But there was no substantial difference between them in luster and the clearness of color. Undershirts were produced from these fabrics of Example and Comparison Example, and wearing tests were conducted. The undershirt of Example was soft to the skin and had a warm feel in comparison with that of Comparison Example, and gave a good wearing feel as an underwear.

As explained hereinabove, the yarn produced according to the present invention has a soft hand feel in comparison with the conventional mercerized yarn, and moreover has good luster and clear color development as a mercerized yarn. Especially, when used for knit fabrics, the yarn can produce a new commercial product which has not been obtained heretofore.

What is claimed is:

1. A method of mercerizing a sliver which comprises impregnating a cellulosic fiber-containing sliver with an aqueous solution of caustic soda of a high concentration; transporting the impregnated slivers held between a belt conveyor and a press belt in a downwardly inclined direction; transferring the sliver from said belt conveyor onto a net conveyor having mesh openings therein; mercerizing the sliver while being transported by said net conveyor, whereby the excessive caustic soda solution on the sliver drips through the mesh openings of the net conveyor; squeezing the caustic soda solution out of the sliver by means of squeeze rollers, and then washing the squeezed sliver with water while transporting said sliver to another net conveyor containing press rollers thereon, said washing being effected by passing the sliver between said net conveyor and press rollers located in a water-washing tub.

2. A method as claimed in claim 1 wherein the caustic soda solution is caused to flow gently on the sliver placed on the belt conveyor and directly before being held by the press belt.

3. An apparatus for mercerizing a sliver which comprises a belt conveyor and a press belt thereon to hold a sliver therebetween and transport the same, said belt conveyor and press belt being inclined downwardly; a feed opening to allow an aqueous solution of caustic soda to flow onto the sliver on the belt conveyor; a net conveyor containing mesh openings therein for receiving the sliver from the belt conveyor and further transporting the sliver thereon, the mercerization of the sliver being effected while being transported by said net conveyor, whereby excessive caustic soda solution from the impregnated sliver flows through the mesh openings on the net conveyor; means to squeeze the sliver at the end of the transportion of the sliver on the net conveyor; and a water tub in which there is arranged another net conveyor and press rollers thereon to hold the sliver therebetween and to transport the sliver in said water tub to wash the sliver with water.

4. An apparatus as claimed in claim 3 wherein the belt conveyor and press belt are made of rubber.

5. An apparatus as claimed in claim 3 wherein the belt conveyor and the net conveyor, which follows said belt conveyor, are arranged in zigzag form.

* * * * *